US011135471B2

(12) United States Patent
Berg

(10) Patent No.: US 11,135,471 B2
(45) Date of Patent: Oct. 5, 2021

(54) BARBELL RACK WITH TILT FUNCTION

(71) Applicant: Eleiko Group AB, Halmstad (SE)

(72) Inventor: Stefan Berg, Halmstad (SE)

(73) Assignee: ELEIKO GROUP AB, Halmstad (SE)

( * ) Notice: Subject to any disclaimer, the term of this patent is extended or adjusted under 35 U.S.C. 154(b) by 41 days.

(21) Appl. No.: 16/832,517

(22) Filed: Mar. 27, 2020

(65) Prior Publication Data

US 2020/0306582 A1 Oct. 1, 2020

(30) Foreign Application Priority Data

Mar. 28, 2019 (SE) ..... 1950382-0

(51) Int. Cl.
*A63B 21/00* (2006.01)
*A63B 21/078* (2006.01)
*A63B 21/06* (2006.01)

(52) U.S. Cl.
CPC .... *A63B 21/4035* (2015.10); *A63B 21/00047* (2013.01); *A63B 21/0605* (2013.01); *A63B 21/078* (2013.01)

(58) Field of Classification Search
CPC ..... A63B 21/4035; A63B 21/00047; A63B 21/0605; A63B 21/078; A63B 2225/09; A63B 21/4029; A63B 23/04; A63B 21/072–075; A63B 21/0783
See application file for complete search history.

(56) References Cited

U.S. PATENT DOCUMENTS

| | | | | |
|---|---|---|---|---|
| 4,302,009 | A | 11/1981 | Johnson | |
| 5,429,570 | A | 7/1995 | Beyer | |
| 5,509,876 | A * | 4/1996 | Reyes | A63B 21/078 482/104 |
| 6,450,927 | B1 | 9/2002 | Ellis | |
| 7,226,400 | B1 * | 6/2007 | Gedeon-Janvier | A63B 21/072 482/104 |
| 8,834,329 | B2 * | 9/2014 | Kelly | A63B 21/0783 482/104 |
| 9,248,335 | B2 * | 2/2016 | Reyes | A63B 21/4029 |
| 10,245,461 | B2 * | 4/2019 | Bruni | A63B 21/4035 |
| 2012/0225756 | A1 | 9/2012 | Reyes | |

(Continued)

OTHER PUBLICATIONS

Garage Gym Review, "Rogue Combo Rack Released!", Jan. 23, 2019, retrieved from the Internet: https://www.garagegymreviews.com/rogue-combo-rack-released (Year: 2019).*

(Continued)

*Primary Examiner* — Megan Anderson
*Assistant Examiner* — Kathleen Vermillera
(74) *Attorney, Agent, or Firm* — Tucker Ellis LLP

(57) ABSTRACT

A barbell rack includes first and second support members arranged for supporting one end of a barbell, first and second foot members with first and second holder parts fixedly attached to respective foot member and which are arranged for tilting the first and second support members within the respective holder part. The barbell rack further includes first and second eccentric each pivotably arranged at the respective holder part and hingedly connected to a respective bracket which respective bracket is fixedly attached to the respective support member for the tilting of the same within the respective holder part.

7 Claims, 3 Drawing Sheets

(56) References Cited

U.S. PATENT DOCUMENTS

| | | | | |
|---|---|---|---|---|
| 2014/0121073 | A1 | 5/2014 | Hardy | |
| 2015/0306443 | A1* | 10/2015 | Bruni, Jr. | A63B 21/0724 482/104 |
| 2021/0128970 | A1* | 5/2021 | Grissel, Jr. | A63B 21/078 |

OTHER PUBLICATIONS

Swedish Search Report for corresponding Swedish Application No. 1950382-0, dated Oct. 22, 2019, 3 pages.

* cited by examiner

BARBELL RACK WITH TILT FUNCTION

RELATED APPLICATION DATA

This application claims the benefit of Swedish Patent Application No. 1950382-0, filed Mar. 28, 2019, the disclosure of which is incorporated herein by reference in its entirety.

TECHNICAL FIELD

The invention considers a barbell rack with an inventive tilt function for tilting the supports (posts) of the barbell rack. A main advantage with the inventive tilt function is that one person can easily operate the tilting, even with full load on the bar, which is a big advantage compared to known solutions.

BACKGROUND ART

Barbell racks are used for different kinds of training exercises or competitions. One type of exercise is for so-called squats, another type is bench press and it also exists combined racks for squats and for bench press. When performing squats, the athlete places the bar (barbell) on his/her shoulders, lifts the bar from the rack, takes a few steps back and then bend the knees to certain point and then presses the bar upwards again until a stand up position. Most athletes grab the bar inside the supports (other names: posts, uprights) while big athletes need to grab the bar outside the supports since the available space between the supports is to narrow. During a competition, there is a need to change the position of the supports from a straight position to a tilted position many times.

All kinds of racks are used both at public gyms, at home and on competitions and the combined racks may be referred to as "squat/bench combo", "combo rack" and similar names. The competition type of racks follow certifications and standards set by the International Powerlifting Federation (IPF) and the "IPF-racks" or "IPF-benches" are of course designed to be robust and safe but also at the same time very flexible. The flexibility may for example concern adjustment of the height to the barbell supports, adjustment of the width between the posts and a "knock-down" design. Below, the racks, including the squat rack, the bench press rack as well as the combined squat and bench press rack, all preferably of competition type, will be referred to as an IPF-rack or barbell rack.

One problem when it comes to IPF-racks is that it is time consuming to adjust the rack to fit every competitioner during competition, by adjusting the height of the poles and the width between them, and this when heavy weight discs are arranged at the barbell. The height adjustment of the posts may be solved either by remove the discs from the barbell to make it lighter, and then adjust the posts, or have some kind of weight-reducer or lifting function enabling an adjustment of the height when the discs are still arranged on the barbell. To adjust the width between the posts, prior art solutions have a tilt-function, where each post is pivotable around a lower pivot point, and where an enclosing bracket have spacers arranged on opposite sides of the post.

SUMMARY OF THE INVENTION

It is an object of the invention to address at least some of the problems and issues outlined above. It is possible to achieve these objects and others by a barbell rack with a tilt function as defined in the attached independent claims.

According to an aspect of the invention, a barbell rack comprises a first and second support members, each arranged for supporting one end each of a barbell in a using position of the barbell. The first and second support members each has a substantially upright position relative a substrate and they each comprises an elongated first tube and an elongated second tube, wherein the first tube is telescopically arranged relative the second tube. The first support member comprises a first foot member, arranged to support the first support member on the substrate, and the second support member comprises a second foot member, arranged to support the second support member. Further, the first and second support member comprises a first respective a second holder part, which are fixedly attached to the respective foot member and protrudes substantially upwards from the foot members. The first holder part of the first support member encloses at least partially a lower part of the second tube of the first support member, and further the first holder part is arranged for allowing a tilting of the first support member within the first holder part. The second support member is arranged opposite the first support member at a distance from the same and the second holder part of the second support member encloses at least partially a lower part of the second tube of the second support member. Further, the second holder part is arranged for allowing a tilting of the second support member within the second holder part. A first eccentric is pivotably arranged at the first holder part of the first support member and is pivotable around a first pivot point and further hingedly connected to a first bracket, which is fixedly attached to the second tube of the first support member. Upon pivoting, the first eccentric is arranged to tilt the first support member within the first holder part. A second eccentric is pivotably arranged at the second holder part of the second support member and is pivotable around a second pivot point and further hingedly connected to a second bracket, which is fixedly attached to the second tube of the second support member. Upon pivoting, the second eccentric is arranged to tilt the second support member within the second holder part.

A main advantage with the inventive tilt function is that one person can easily operate the tilting, even with full load on the bar and without big efforts, which is a big advantage compared to prior art. The inventive tilt function is very quick, since there is no need to first lift the barbell with external force or equipment, loosen two screws per support, lift the bracket (as in prior art solutions), tilt the support, reposition the bracket and tighten the screws.

According to an embodiment, a first handle is fixedly connected with a first end to the first eccentric and further comprising a second end which is a free end distal from the first end of the first handle. Further, a second handle is fixedly connected with a first end to the second eccentric and further comprising a second end which is a free end distal from the first end of the second handle. It is very quick and easy to operate the tilt function with the handle. The length of the handles may be chosen such as one may operate the tilt function with a very low force, which is far better than prior art solutions.

According to an embodiment, the first bracket comprises an elongate first groove and the first eccentric comprises a first pin, which first pin is arranged a distance from the first pivot point. The first pin is arranged in the first groove and moveable therein when pivoting the first eccentric. The second bracket comprises an elongate second groove and the second eccentric comprises a second pin, which second pin is arranged a distance from the second pivot point. The second pin is arranged in the second groove and moveable therein when pivoting the second eccentric. A simple and cost efficient solution for pivoting the eccentric is thereby achieved.

According to an embodiment, the first eccentric is arranged at an upper end of the first holder part and the upper end of first holder part comprises a first cut out, in which the first bracket of the first support member is arranged to run. In the same way, the second eccentric is arranged at an upper end of the second holder part and the upper end of the second holder part comprises a second cut out in which the second bracket of the second support member is arranged to run.

According to an embodiment, the first holder part comprises at least one inclined wall enabling the tilting of the first support member within the first holder part, and the second holder part comprises a least one inclined wall enabling the tilting of the second of the second support member within the second holder part.

In yet another embodiment, the first foot member and the second foot member are connected to each other by a connecting frame part. To connect the foot members rigidly, a robust and steady foot arrangement is achieved.

According to an embodiment, the distance between the first foot member and the second foot member is adjustable by that the connecting frame part is telescopically arranged relative a part of the first foot member and/or a part of the second foot member. By such a solution, the barbell rack may be adjusted also at floor level and the possible distance between the support members is even more flexible compared to a fixed distance between the support members.

Further possible features and benefits of this solution will become apparent from the detailed description below.

BRIEF DESCRIPTION OF DRAWINGS

The solution will now be described in more detail by means of exemplary embodiments and with reference to the accompanying drawings, in which.

DETAILED DESCRIPTION

Figure 1A:
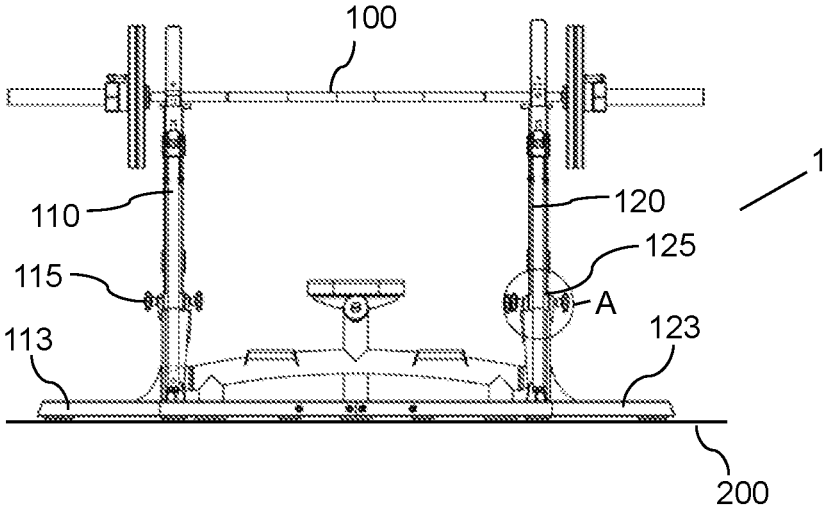
Fig. 1A PRIOR ART
FIGS. 1A-1D are front views and detail views of a prior art barbell rack in an upright position and in a tilted position, and where the barbell is in a ready position for performing a squat.
Figure 1B:
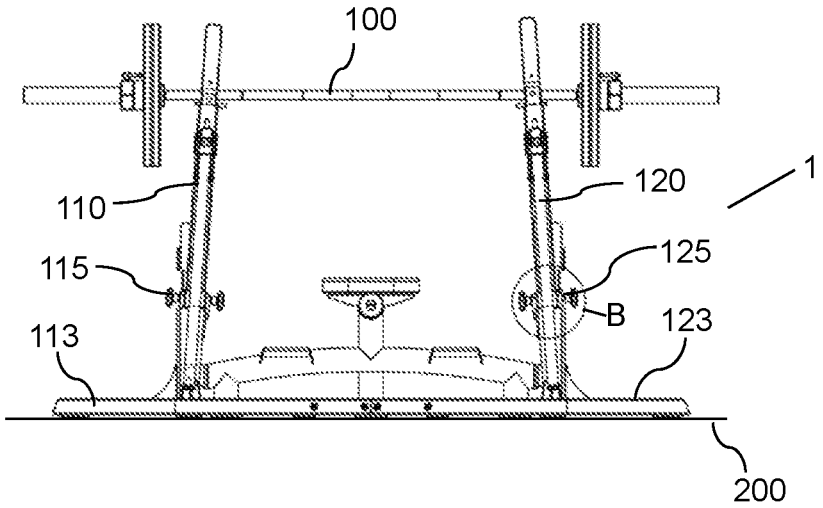
Fig. 1B PRIOR ART
Figure 1C:
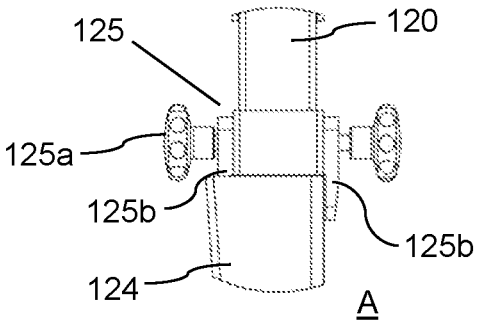
Fig. 1C PRIOR ART
Figure 1D:
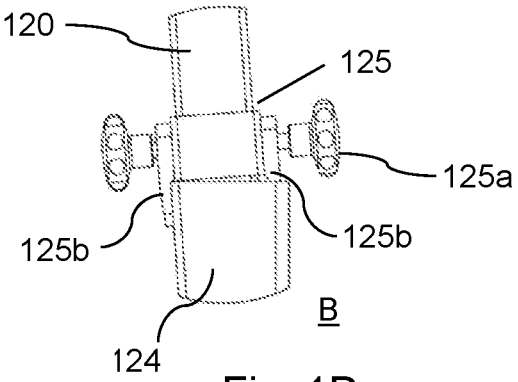
Fig. 1D PRIOR ART

FIGS. 1A-1D show a prior art solution of a barbell rack 1 positioned on a substrate 200, i.e. a floor, and which comprises two support members 110, 120 with a respective foot member 113, 123 connected with a lower frame part. Each support member 110, 120 is pivotable around a lower pivot point of the respective support member 110, 120, and an enclosing bracket 115, 125 have spacers 125*b* arranged on opposite sides of the support member 110, 120. Referring to FIG. 1C and the upright position of the support member 120, the left spacer 125*b* of the bracket 125 is introduced in a gap between the support member 120 and an enclosing holder part 124. The holder part 124 is connected to the foot member 123, i.e. normally the holder part 124 is an enclosing tube, which is welded to the foot member and is designed as a widening tube protruding upwards. The right spacer 125*b* which is not at use in the upright position of the support member 120 is arranged on the outside of the enclosing holder part/tube 124. Further, an inner and an outer (left and right) screw 125*a* secures the spacers 125*b* to the support member 120 and the holder part 124. To tilt the support member 120 inwardly, the screws 125*a* have to be loosened and the enclosing bracket 125 must be lifted a bit, such as the spacers 125*b* are above the holder part 124, and then the support member 120 must be pressed inwardly (to the left), such as the right spacer 125*b* may be introduced in the gap between the support member 120 and the enclosing holder part 124, which gap occurs when the support member 120 is tilted inwardly. Thus, in the tilted position of the support member 120, the inner spacer 125*b* of the bracket 125 is positioned on the outside (left side in FIG. 1D) of the enclosing holder part 124, which outside faces the opposite support member 110. After the re-positioning of the bracket 125, the screws 125*a* secure the new position. Since the barbell 100 may be loaded with a lot of weight, this tilting is very hard to perform. Some barbell racks 1 has a lifting function which lift the barbell 100 before the tilting is possible. If there is no such extra "lifting device", the tilting of the support members 110, 120 is very hard to perform and it is sometimes performed by kicking the supports to or from the tilting position, which does not look very professional, especially during competitions and TV-broadcasted competitions.

Figure 2A:
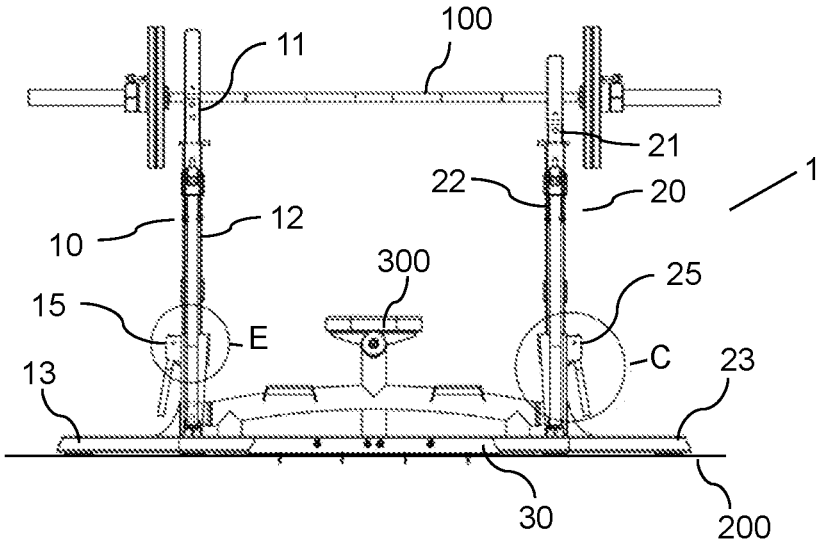
FIGS. 2A-2D are front views and detail views of a barbell rack according to the invention, and where the barbell is in a ready position for performing a squat. The tilted position of the supports enabling a grip outside the supports, which may be a demand from the athlete.

FIG. 2A is a front view of a barbell rack 1 according to the invention, with the barbell 100 resting on first and second support members 10, 20, which are in an upright position, and where the barbell 100 is in a ready position for performing a squat. In the figure, a bench 300 also is visible, since the barbell rack 1 according to the figures is a combined squat/bench rack 1, but the bench 300 is an option which may be a part of the barbell rack 1 or not or may be dismountable to the rack 1.

Figure 2B:
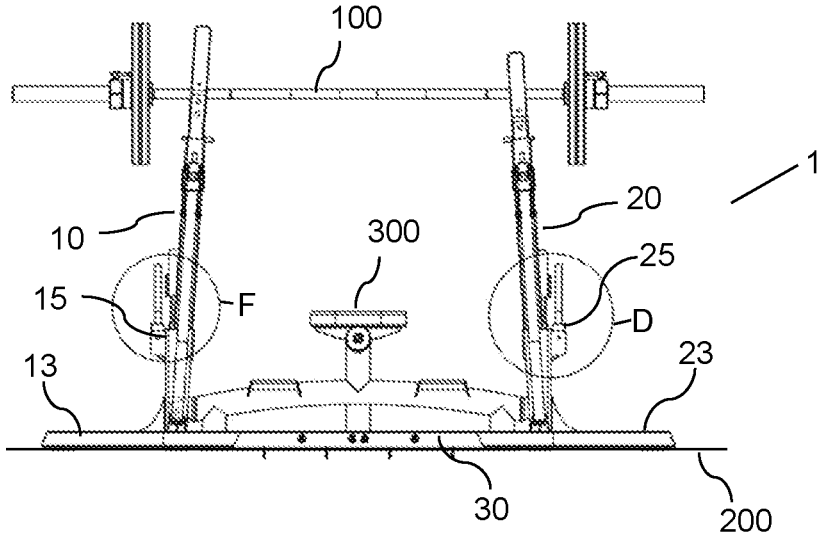
Figure 2C:
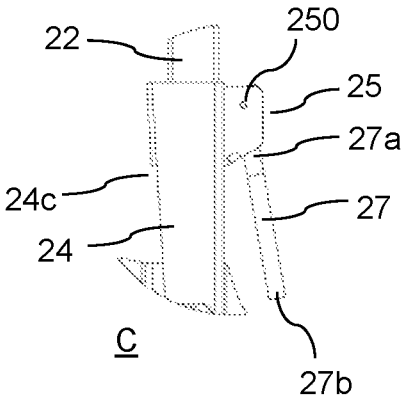
Figure 2D:
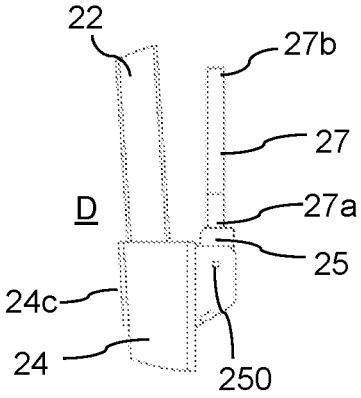

FIG. 2B is a front view of the barbell rack 1 when the first and second support members 10, 20 are tilted slightly inwards, towards each other. FIGS. 2C-2D are zoomed views of detail C and detail D of the second support member 20, but it is to be understood that the first support member 10 is a "mirror-copy" of the second support member 20. The first and second support members 10, 20 each is arranged to support one end of the barbell 100 and thus comprise some kind of rests or fork-like holders in different positions, typically at the top and in one or two more positions along the support member.

The views in FIGS. 2C-2D show the second support member 20, but the first support member 10 looks the same, but is mirrored. The first and second support member 10, 20 each comprises an elongated first tube 11, 21 and an elongated second tube 12, 22, wherein the first tube 11, 21 is telescopically arranged relative the second tube 12, 22. A first and second foot member 13, 23 is respectively arranged to support the first and second support member 10, 20 on a substrate 200. The foot members 13, 23 is connected with a connecting frame part 30 which in this case is a fixed connection, and the foot members 13, 23 and the connecting frame part 30 actually is one part which normally is welded together to one unit. The connecting frame part 30 may as well be designed as a dismountable part which also may be adjustable in length relative the one or both foot members, such as also the distance between the first and second support member 10, 20 at "floor level" may be adjusted. A first and second holder part 14, 24, i.e. a short tube, is fixedly attached to the respective first and second foot member 13, 23 and protrudes upwards from the foot members 13, 23. Each holder part 14, 24 encloses a lower part 12*a*, 22*a* of the second tube 12, 22 of the respective support member 10, 20. The first and second holder part 14, 24 is respectively arranged for allowing a tilting of the respective support member 10, 20 within the respective first and second holder part 14, 24, by that the first and second holder part 14, 24 each comprises at least one inclined wall 14*c*, 24*c*, which enables the tilting of the first and the second support member 10, 20 within the holder part 14, 24. The first holder part 14 comprises a first eccentric 15, which is pivotally arranged at the outside of the first holder part 14 and is pivotable around a first pivot point 150. A first handle 17 is fixedly connected with a first end 17*a* to the first eccentric 15 and a second end 17*b* of the first handle 17 is a free end, which is distal from the first end 17*a*. In the same way, a second eccentric 25 is pivotably arranged at the outside of the second holder part 24 and is pivotable around a second pivot point 250 and a second handle 27 is fixedly connected with a first end 27*a* to the second eccentric 25 and a second end 27*b* of the handle 27 is a free end, which is distal from the first end 27*a*.

FIG. 2C shows a zoomed view of the second support member 20 and shows a part of the second tube 22 in an upright position inside the second holder part 24. The second handle 27 is directed downwards in this state and the second eccentric 25 (not visible) is in position where the second support member 20 (i.e. the second tube 22) is held in the upright position. FIG. 2D shows the tilted position where the second handle 27 is directed upwards and the second eccentric 25 is in this position allowing the tilted position of the second support member 20.

Figure 3A:
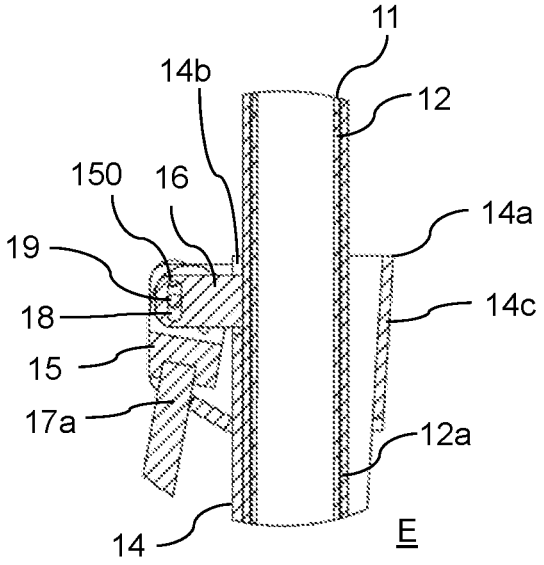
FIGS. 3A-3B are section views of detail E and detail F of the left support of the barbell rack of FIGS. 2A-2B, which shows the inventive tilt function.
Figure 3B:
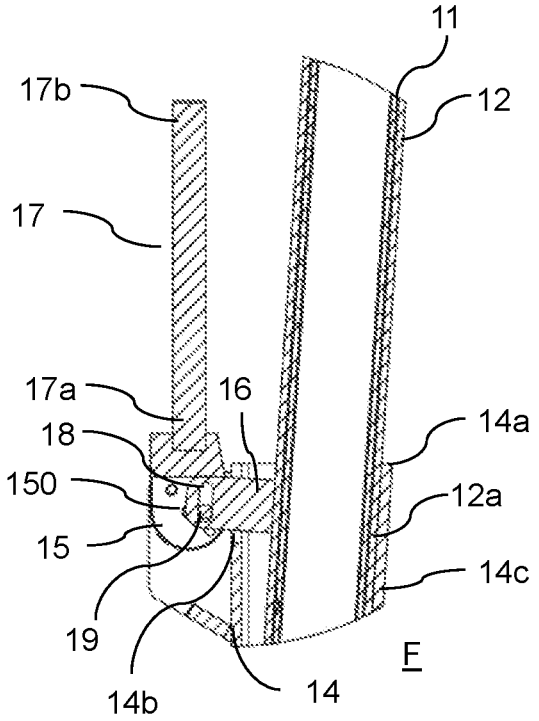

FIGS. 3A-3B are zoomed section views of detail E of FIG. 2A and detail F of FIG. 2B. which relates to the first support member 10 (the left one in the figures). It is understood that the same constructional design applies to the second support member 20 positioned to the right. The elongated first tube 11 is telescopically arranged inside the elongated second tube 12, and the first and second tubes 11, 12 constitutes the first support member 10. The latter is arranged with its lower end 12*a* inside the first holder part 14 and is tiltable inside the same by that the first holder part 14 comprises an inclined wall 14*c*. The first holder part 14 preferably is a quadratic tube with three vertical walls and the inclined wall 14*c* as the fourth wall. The first eccentric 15 is pivotally arranged at an outside of an upper end 14*a* of the first holder part 14 and preferably is fitted between two flanges which protrude from the holder part 14. In the figures, one flange can be seen behind the eccentric 15 and the other one is not visible. The first eccentric 15 is pivotably attached to the flanges and is pivotable around a first pivot point 150. Further, the first eccentric 15 is hingedly connected to a first bracket 16 which in turn is fixedly attached to the second tube 12 of the first support member 10. When pivoting the first eccentric 15, the first support member 10 is tilted from the upright position (position E, FIG. 3A) to the tilted position (position F, FIG. 3B), inside the first holder part 14. To facilitate the movement and allowing the movement of the first bracket 16, the first holder part 14 comprises a first cut out 14*b* in which the first bracket 16 of the first support 10 is arranged to run. The first bracket 16 comprises an elongate first groove 18 and the first eccentric 15 comprises a first pin 19, which is arranged at a distance from the first pivot point 150. The first pin 19 is arranged in the first groove 18 of the first bracket 16 and moveable therein when pivoting the first eccentric 15 between the upright and the tilted positions. Thus, when moving the first handle 17 between a downward direction E to an upward direction F, the tilting of the first support 10 is performed. This, by that the eccentric design of the first eccentric 15 in the different positions, means different distance between an outer edge of the eccentric 15 and an abutment surface of the holder part 14, and thus a motion of the first bracket 16 and the first support member 10 is achieved.

The invention claimed is:

1. A barbell rack comprising:

a first support member arranged for supporting one end of a barbell in a using position of the barbell, the first support member having an upright position relative a substrate, wherein the first support member comprises an elongated first tube and an elongated second tube, wherein the first tube is telescopically arranged relative the second tube, a first foot member, arranged to support the first support member on the substrate, a first holder part fixedly attached to the first foot member and protruding upwards from the first foot member, and which first holder part at least partially encloses a lower part of the second tube of the first support member, and further the first holder part is arranged for allowing a tilting of the first support member within the first holder part, a second support member arranged for supporting one end of the barbell in the using position of the barbell, wherein the second support member is arranged opposite the first support member at a distance, the second support member having an upright position relative the substrate, wherein the second support member comprises an elongated first tube and an elongated second tube, wherein the first tube is telescopically arranged relative the second tube, a second foot member, arranged to support the second support member on the substrate, a second holder part fixedly attached to the second foot member and protruding upwards from the second foot member, and which second holder part at least partially encloses a lower part of the second tube of the second support member, and further the second holder part is arranged for allowing a tilting of the second support member within the second holder part, a first eccentric pivotably arranged at the first holder part of the first support member and pivotable around a first pivot point and further hingedly connected to a first bracket which first bracket is fixedly attached to the second tube of the first support member, wherein the first eccentric upon pivoting is arranged to tilt the first support member within the first holder part, a second eccentric pivotably arranged at the second holder part of the second support member and pivotable around a second pivot point and further hingedly connected to a second bracket which second bracket is fixedly attached to the second tube of the second support member, wherein the second eccentric upon pivoting is arranged to tilt the second support member within the second holder part.

2. The barbell rack according to claim 1, wherein the first foot member and the second foot member are connected to each other by a connecting frame part.

3. The barbell rack according to claim 2, wherein a distance between the first foot member and the second foot member is adjustable by that the connecting frame part is telescopically arranged relative to a part of the first foot member and/or a part of the second foot member.

4. The barbell rack according to claim 1, wherein a first handle is fixedly connected with a first end to the first eccentric and further comprising a second end which is a free end distal from the first end of the first handle, and a second handle is fixedly connected with a first end to the second eccentric and further comprising a second end which is a free end distal from the first end of the second handle.

5. The barbell rack according to claim 1, wherein the first bracket comprises an elongate first groove and the first eccentric comprises a first pin, which first pin is arranged a distance from the first pivot point, wherein the first pin is arranged in the first groove and moveable therein when pivoting the first eccentric, and the second bracket comprises an elongate second groove and the second eccentric comprises a second pin, which second pin is arranged a distance from the second pivot point, wherein the second pin is arranged in the second groove and moveable therein when pivoting the second eccentric.

6. The barbell rack according to claim 1, wherein the first eccentric is arranged at an upper end of the first holder part and the upper end of first holder part comprises a first cut out in which the first bracket of the first support member is arranged to run, and the second eccentric is arranged at an upper end of the second holder part and the upper end of the second holder part comprises a second cut out in which the second bracket of the second support member is arranged to run.

7. The barbell rack according to claim 1, wherein the first holder part comprises at least one inclined wall enabling the tilting of the first support member within the first holder part, and the second holder part comprises a least one inclined wall enabling the tilting of the second support member within the second holder part.

* * * * *